US006777614B1

(12) United States Patent
Suenwoldt

(10) Patent No.: US 6,777,614 B1
(45) Date of Patent: Aug. 17, 2004

(54) SURGE SUPPRESSOR WITH A BRACING ELEMENT

(75) Inventor: Olaf Suenwoldt, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/069,132

(22) PCT Filed: Aug. 23, 2000

(86) PCT No.: PCT/DE00/02916

§ 371 (c)(1),
(2), (4) Date: Jul. 1, 2002

(87) PCT Pub. No.: WO01/15292

PCT Pub. Date: Mar. 1, 2001

(30) Foreign Application Priority Data

Aug. 23, 1999 (DE) ..... 199 40 939

(51) Int. Cl.[7] ..... H01R 13/46
(52) U.S. Cl. ..... 174/53; 174/50; 361/117
(58) Field of Search ..... 174/53, 50; 361/117

(56) References Cited

U.S. PATENT DOCUMENTS 2,704,357 A * 3/1955 Schmidt ..... 174/151
5,444,429 A * 8/1995 Sakich et al. ..... 338/21
5,912,434 A * 6/1999 Robinson ..... 174/51
5,936,826 A * 8/1999 Schmidt ..... 361/117

FOREIGN PATENT DOCUMENTS

| | | | | |
|---|---|---|---|---|
| DE | 0280189 A1 * | 2/1988 | ..... | 338/21 |
| DE | 196 33 720 A1 | 2/1998 | ..... | 338/21 |
| DE | 299 05 311 U1 | 7/1999 | ..... | 338/21 |
| EP | 0280 189 A1 | 8/1988 | ..... | 338/21 |
| JP | 63312602 | 12/1988 | ..... | 338/21 |
| JP | 06310307 | 11/1994 | ..... | 338/21 |
| JP | 08213211 A | 8/1996 | ..... | 338/21 |

* cited by examiner

*Primary Examiner*—Dean A. Reichard
*Assistant Examiner*—Anton Harris
(74) *Attorney, Agent, or Firm*—Morrison & Foerster LLP

(57) ABSTRACT

The invention relates to a surge suppressor for a high voltage or a medium voltage. The pack of said surge suppressor consists of arrester elements (1, 2, 3) and terminal armatures (4, 5) and is axially held together by means of bracing elements (6, 7, 8) in the form of epoxy resin rods. Said bracing elements (6, 7, 8) are held in the terminal armatures in a self-locking manner by means of conical bracing cylinders (9, 10, 11, 12, 13, 14). Said bracing cylinders are arrested on the bracing elements (6, 7, 8) when a tensile force is applied in the conical bores of the terminal armatures.

11 Claims, 2 Drawing Sheets

SURGE SUPPRESSOR WITH A BRACING ELEMENT

The invention relates to a surge arrester having at least one dissipation element, which is arranged between two electrically conductive end fittings, and having at least one bracing element, which is attached to the two end fittings and, in the axial direction, holds together the stack formed from the dissipation element and the end fittings.

A surge arrester such as this is known, for example, from Japanese Patent Application No. 62/149511.

In that document, a number of dissipation elements are combined to form a cylindrical stack, which also has an end fitting at each of its ends, with the end fittings having recesses for bracing elements in the form of rods. The bracing elements are braced between the end fittings by means of threaded nuts, with the threaded nuts resting on the edges of the recesses of the end fittings.

When assembling such a surge arrester, the individual nuts must be screwed tight, and a uniform pressure distribution should be ensured on the circumference of the end fittings.

The present invention is based on the object of simplifying the assembly process and of reliably bracing the stack for a surge arrester of the type mentioned initially.

According to the invention, the object is achieved in that the bracing element is held in a bracing sleeve in at least one end fitting, in that the external contour of the bracing sleeve tapers conically in the axial direction toward the center of the stack in a conical region, in that the bracing sleeve has a hole for holding a bracing element, the boundary walls of which hole can move toward the interior of the hole at least in the conical region, and in that the end fitting has a recess passing through it, for holding in each case one clamping sleeve, into which recess the respective clamping sleeve can be at least partially pushed, with the conical region being deformed.

For attachment to the end fitting, the bracing element can be pushed into the bracing sleeve, which is then inserted into the recess passing through it, within the end fitting. The already assembled stack is then fixed, and a tensile stress is applied to the bracing element. This elastically lengthens the bracing element. The spring stress in the bracing element is stored by at least one spacer in the stack compensating for the bracing movement. Such a spacer may be provided, for example, by a spacing screw which can move between an end fitting and the dissipation elements. The bracing sleeve can be pushed into the recess passing through the end fitting until the conical region of the bracing sleeve abuts against the walls of the recess passing through the end fitting, so that the boundary walls start to move radially toward the hole interior onto the bracing element.

This further deforms the conical region of the bracing sleeve, and the boundary walls are pressed radially inward onto the bracing element. The bracing element is thus held in the bracing sleeve by a force fit. To do this, the dimensions and shapes of the recess passing through the end fitting and of the bracing sleeve must be appropriately matched to one another. The conicity of the bracing sleeve must likewise be suitably configured.

The bracing element advantageously consists of a fiber-reinforced epoxy resin. The radial introduction of force into the bracing element by means of the force fit with respect to the bracing sleeve firstly results in there being no notch effect on the bracing element while, secondly, virtually the entire cross section of the bracing element is used to transmit the axial force. The axial bracing of the stack automatically holds the bracing element in the bracing sleeve.

It is advantageously possible to provide for the recess passing through the end fitting to be designed to be complementary to the conical region of the bracing sleeve.

This means that it is particularly simple to compress the bracing sleeve in the desired manner while exerting axial tension toward the bracing element.

Furthermore, it is advantageously possible to provide for the bracing sleeve to be slotted in the conical region, so that the boundary walls of the hole can move in a radially sprung manner in the conical region.

The slotting in the bracing sleeve makes it particularly simple for the boundary walls of the hole to move radially in the bracing sleeve.

A further advantageous refinement of the invention provides for the bracing element to be held by means of a bracing sleeve in each of the end fittings.

It is also advantageously possible to provide for a number of bracing elements to be provided, parallel to the axis of the stack, on its external circumference.

This makes it possible to distribute the large axial forces in the dissipation stack well between a number of bracing elements. The uniform distribution of the tensile forces between the various bracing elements is produced automatically. Furthermore, the use of a number of bracing elements results in greater mechanical strength.

It is also advantageously possible to provide for the end fittings to project radially beyond the dissipation elements and, in the projecting region, to have conical holes for holding the respective bracing sleeves.

In this way, the bracing elements can be used to form a cage which surrounds the dissipation elements and which, for example, can be encapsulated with a silicone elastomer, together with the dissipation elements, while the surge arrester is being manufactured.

In addition, it is advantageously possible to provide for each bracing sleeve to have a hole whose shape is designed to form an accurate fit with the external contour of the respective bracing element.

This allows a particularly effective force fit to be achieved between the respective bracing sleeve and the bracing element.

In the following text, the invention will be illustrated using an exemplary embodiment in a drawing, and will then be described.

Figure 1:
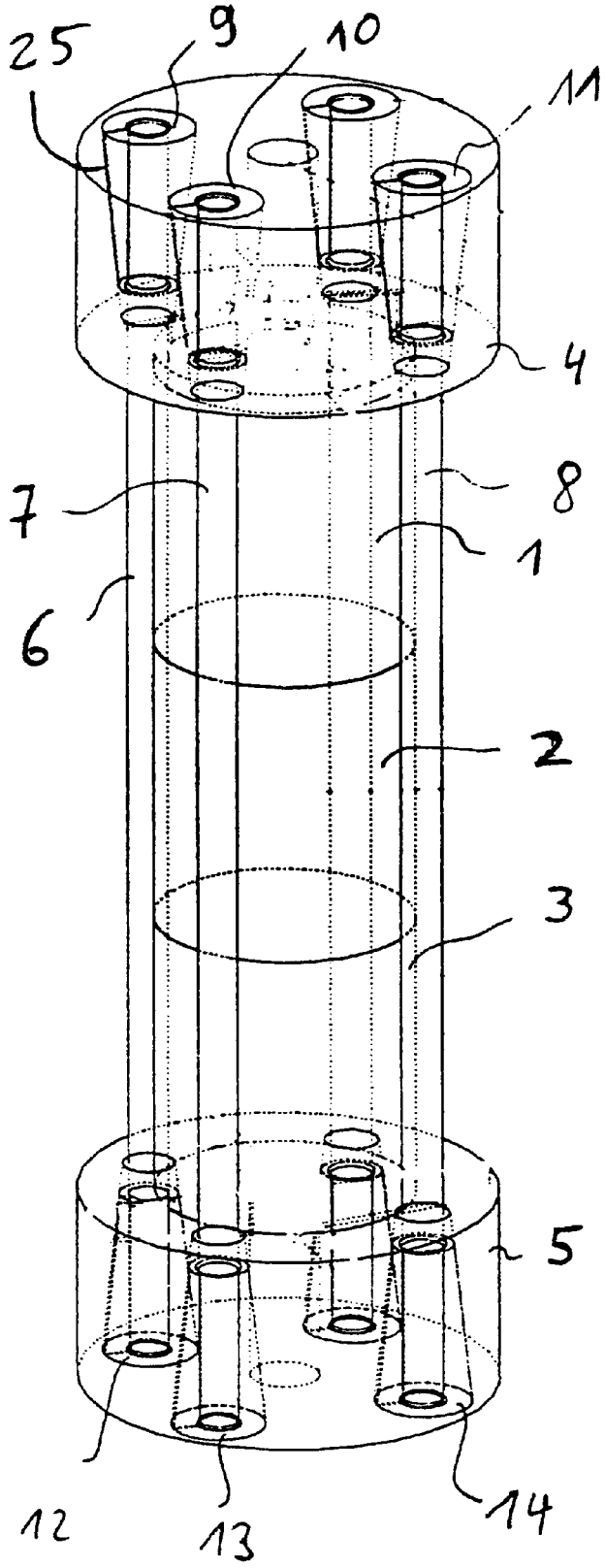
FIG. 1 shows a schematic view of a surge arrester.

FIG. 1 shows schematically, the surge arrester with a stack comprising the dissipation elements 1, 2, 3 and the end fittings 4, 5. The dissipation elements are composed, for example, of zinc oxide. Each dissipation element is metallized on its end surfaces, so that axial compression of the end fittings 4, 5 and of the dissipation elements 1, 2, 3 results in a conductive connection between the dissipation elements. When dissipation occurs, that is to say when the voltage applied to the surge arrester exceeds a critical value, a dissipation current can then flow from one end fitting 4 via the dissipation elements 1, 2, 3 to the other end fitting.

The bracing elements 6, 7, 8 are provided in order to brace the stack and are in the form of rods having a circular cross section and composed of fiber-reinforced epoxy resin. The reinforcing fibers may, for example, be glass fibers.

At their ends, the bracing elements 6, 7, 8 are each held in a bracing sleeve 9, 10, 11, 12, 13, 14.

Figure 2:
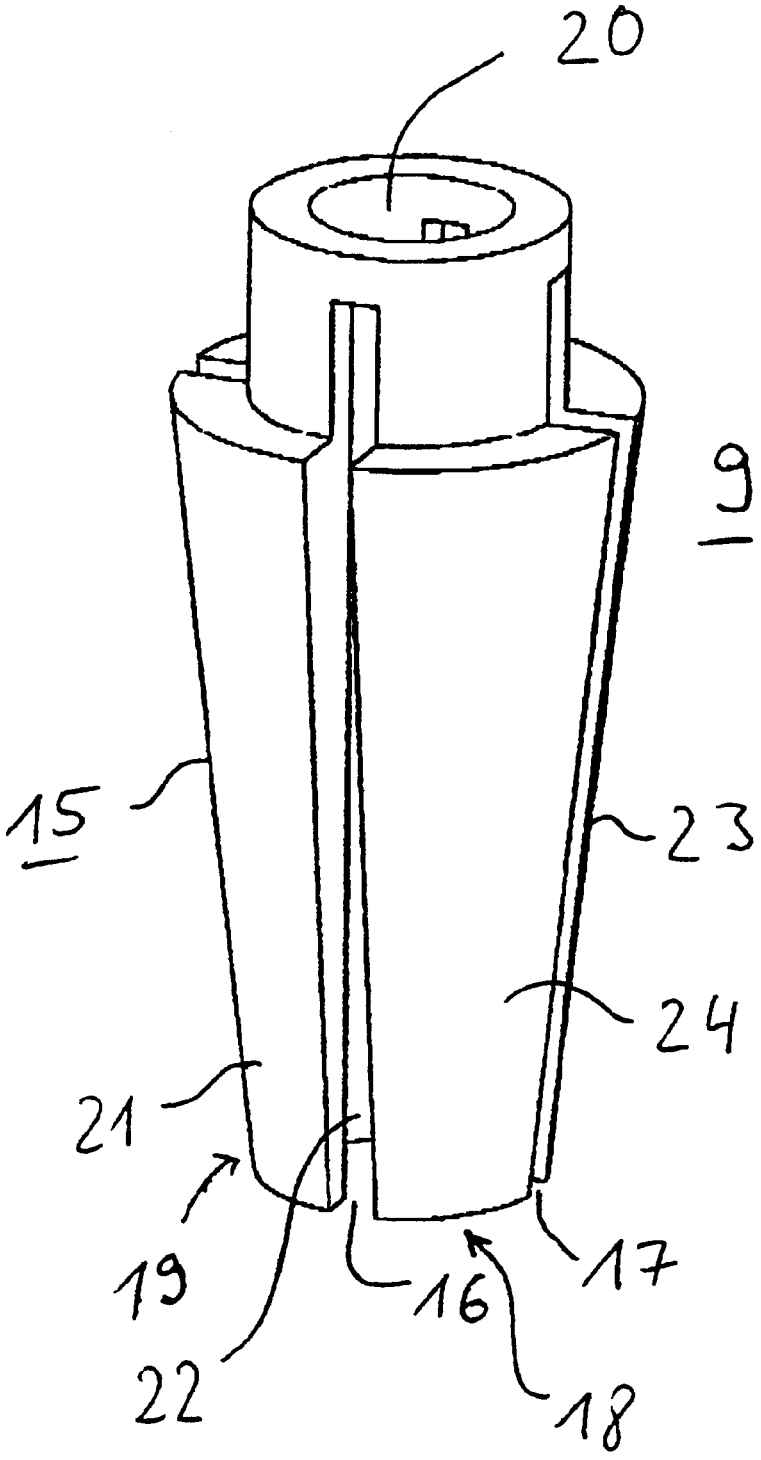
FIG. 2 shows the view of a bracing sleeve.

As FIG. 2 shows, each bracing sleeve is in the form of a hollow cylinder and has a conical region 15 which tapers conically axially toward the center of the stack.

In its interior, the bracing sleeve 9 has a hole 20, which is matched to form an accurate fit with the external contour of a clamping element 6.

Slots 16, 17, 18, 19, which pass through the bracing sleeve 9, are provided in it in the conical region 15, and allow the boundary walls 21, 22, 23, 24 of the hole 20 which passes through the bracing sleeve 9 to move in a sprung manner in the conical region 15, radially with respect to the longitudinal axis of the bracing sleeve 9.

Each of the end fittings 4, 5 has recesses in the form of conical holes, each of which holds a bracing sleeve 9, 10, 11, 12, 13, 14.

When tensile forces are applied to the bracing elements 6, 7, 8, the bracing sleeves 9, 10, 11, 12, 13, 14 are drawn into the conical holes in the end fittings, so that the boundary walls 21, 22, 23, 24 are pressed inward onto the respective bracing element 6, 7, 8, which is held in the bracing sleeve 9, 10, 11, 12, 13, 14, and are fixed with a force fit.

This force-fitting joint between the respective bracing element 6, 7, 8 and the clamping sleeve means that the tensile force is introduced in an optimum manner into the bracing elements 6, 7, 8, so that they are loaded uniformly over their entire cross section.

The procedure for assembly of such a surge arrester comprises the stack 1, 2, 3, 4, 5 being assembled in advance first of all, the bracing elements 6, 7, 8 and the corresponding bracing sleeves being pushed in, and, after this, the bracing elements being lengthened axially. The increase in length is compensated for by screwing in a contact screw, which is supported on a dissipation element or on a metal plate adjacent to it, and is guided in a thread in an end fitting. The spring force which is stored in the bracing elements in this way thus results in the dissipation elements being compressed axially all the time.

What is claimed is:

1. A surge arrester, comprising:

at least one dissipation element arranged between two electrically conductive end fittings; and at least one bracing element attached to the two end fittings and, in an axial direction, holds together a stack formed from the dissipation element and the end fittings, wherein the bracing element arranged in a bracing sleeve in at least one end fitting, an external contour of the bracing sleeve tapers conically in an axial direction toward a center of the stack in a conical region, the bracing sleeve has a hole for holding a bracing element, the hole having boundary walls configured to move toward the interior of the hole at least in the conical region, the end fitting has a recess passing therethrough, for holding a clamping sleeve, into which recess the respective bracing sleeve can be at least partially pushed, with the conical region being deformed, and the bracing sleeve is self-locking such that the bracing sleeve is securely attached to the bracing element.

2. The surge arrester as claimed in claim 1, wherein the recess passing through the end fitting is configured to be complementary to the conical region of the bracing sleeve.

3. The surge arrester as claimed in claim 1, the bracing sleeve is slotted in the conical region, so that the boundary walls of the hole can move in a radially sprung manner in the conical region.

4. The surge arrester as claimed in claim 1, wherein the bracing element is held by means of a bracing sleeve in the end fittings.

5. The surge arrester as claimed in claim 1, wherein a number of bracing elements are provided, parallel to an axis of the stack, on its outer circumference.

6. The surge arrester as claimed in claim 5, wherein the end fittings project radially beyond the dissipation elements and, in the projecting region, have conical holes for holding the respective bracing sleeves.

7. The surge arrester as claimed in claim 1, wherein each bracing sleeve has a hole whose shape is configured to form an accurate fit with the external contour of the respective bracing element.

8. The surge arrester as claimed in claim 2, the bracing sleeve is slotted in the conical region, so that the boundary walls of the hole can move in a radially sprung manner in the conical region.

9. The surge arrester as claimed in claim 3, the bracing sleeve is slotted in the conical region, so that the boundary walls of the hole can move in a radially sprung manner in the conical region.

10. The surge arrester as claimed in claim 2, wherein the bracing element is held by means of a bracing sleeve in the end fittings.

11. The surge arrester as claimed in claim 3, wherein the bracing element is held by means of a bracing sleeve in the end fittings.

* * * * *